US010135167B2

(12) United States Patent
Wollitzer et al.

(10) Patent No.: US 10,135,167 B2
(45) Date of Patent: Nov. 20, 2018

(54) CONTACT LAMELLA PART AND PLUG CONNECTOR WITH CONTACT LAMELLA PART

(71) Applicant: ROSENBERGER HOCHFREQUENZTECHNIK GMBH & CO. KG, Fridolfing (DE)

(72) Inventors: Michael Wollitzer, Fridolfing (DE); Christian Maier, Griesstätt (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 15/756,243

(22) PCT Filed: Aug. 23, 2016

(86) PCT No.: PCT/EP2016/001423

§ 371 (c)(1),
(2) Date: Feb. 28, 2018

(87) PCT Pub. No.: WO2017/054896

PCT Pub. Date: Apr. 6, 2017

(65) Prior Publication Data

US 2018/0248290 A1 Aug. 30, 2018

(30) Foreign Application Priority Data

Sep. 29, 2015 (DE) ..... 20 2015 006 807 U

(51) Int. Cl.

| | |
|---|---|
| ***H01R 13/187*** | (2006.01) |
| ***H01R 13/11*** | (2006.01) |
| ***H01R 4/48*** | (2006.01) |

(52) U.S. Cl.
CPC ..... *H01R 13/187* (2013.01); *H01R 4/4881* (2013.01); *H01R 13/111* (2013.01)

(58) Field of Classification Search
None
See application file for complete search history.

(56) References Cited

U.S. PATENT DOCUMENTS 4,299,431 A * 11/1981 Wilson ..... H01R 13/523 439/205
5,261,840 A * 11/1993 Benz ..... H01R 4/4881 439/843
5,588,884 A * 12/1996 Rudoy ..... H01R 13/187 439/787

(Continued)

FOREIGN PATENT DOCUMENTS

DE 2049739 A 4/1972
EP 2720322 A1 4/2014

*Primary Examiner* — Harshad C Patel
(74) *Attorney, Agent, or Firm* — DeLio, Peterson & Curcio, LLC; Robert Curcio

(57) ABSTRACT

A contact lamella part for transmitting an electrical current or signal between a first contact element, such as a contact socket, and a second contact element which can be coupled thereto, such as a contact pin, having a plurality of contact lamellae extending substantially parallel to one another in a longitudinal direction (L), each having a contact zone for contacting the first contact element and/or the second contact element, wherein the contact zone of a first contact lamella is arranged offset in the longitudinal direction (L) in relation to the contact zone of a second contact lamella.

18 Claims, 5 Drawing Sheets

(56) References Cited

U.S. PATENT DOCUMENTS

| | | | | |
|---|---|---|---|---|
| 6,062,919 | A * | 5/2000 | Trafton | H01R 13/187 439/843 |
| 6,296,519 | B1 * | 10/2001 | Hashizawa | H01R 13/6599 439/607.42 |
| 8,057,269 | B2 * | 11/2011 | Ledermann | H01R 13/187 439/827 |
| 8,128,441 | B2 * | 3/2012 | Mukuno | H01R 13/187 439/845 |
| 8,784,143 | B2 * | 7/2014 | Edgell | A61N 1/3752 439/246 |
| 2014/0099843 | A1 * | 4/2014 | Ito | H01R 13/187 439/884 |
| 2016/0211590 | A1 * | 7/2016 | Saur | H01R 4/48 |

* cited by examiner

CONTACT LAMELLA PART AND PLUG CONNECTOR WITH CONTACT LAMELLA PART

BACKGROUND OF THE INVENTION

1. Field of the Invention

The invention relates to a contact lamella part for the transmission of an electrical current or of an electrical signal between a first contact element and a second contact element which can be coupled therewith. The contact lamella part has a plurality of contact lamellae extending substantially parallel to one another in a longitudinal direction, in each case with a contact zone for establishing electrical contact with the first contact element and/or the second contact element.

The first contact element is for example a contact socket into which the second contact element, in the form of a contact pin or contact plug, can be introduced in a plugging direction for the purpose of coupling, whereby the contact lamella part forms a current flow path between the contact socket and the contact plug. The invention further relates to a plug connector having such a contact lamella part.

2. Description of Related Art

Contact lamella parts with a plurality of contact lamellae for the transmission of electrical currents or signals between two contact elements are known. The contact lamellae are thereby often elastic or flexible in design such that in the coupled state they lie, under a mechanical preload, closely against at least one of the contact elements in order, in this way, to ensure a low contact resistance between the contact lamella part and the contact element.

SUMMARY OF THE INVENTION

In view of the problems described, it is the object of the present invention to provide a contact lamella part suitable for the transmission of high current or HF signals which at the same time allows particularly simple installation.

This object is achieved according to the invention by means of a contact lamella part with the characterizing features of the independent claims including by means of a plug connector. Advantageous further developments of the invention are described in the dependent claims.

The above and other objects, which will be apparent to those skilled in the art, are achieved in the present invention which is directed to a contact lamella part for the transmission of an electrical current or signals between a first contact element and a second contact element which can be coupled therewith, with a plurality of contact lamellae extending substantially parallel to one another in a longitudinal direction (L), in each case with a contact zone for establishing electrical contact with the first contact element and/or the second contact element, wherein the contact zone of a first contact lamella is arranged offset in the longitudinal direction (L) in relation to the contact zone of a second contact lamella, wherein the contact lamellae each have torsion web which, starting out from a first lamella end, is increasingly tilted out of a lamella plane, at least in the contact zone, wherein the lamella plane is a tangent plane to an untilted surface of the torsion web, wherein the torsion web has a first width (B1), at least in the region the contact zone, such that the torsion web transitions, in the direction of the other lamella end, into a connecting bar with a second width (B2) which is less than the first width (B1).

The contact lamellae are, at least in the region of their contact zones, in each case twisted around their own longitudinal axis (A).

The first contact lamella is preferably adjacent to the second contact lamella.

The contact zones of adjacent contact lamellae may be arranged alternatingly in two contact planes (E1, E2) spaced apart from one another and running perpendicular to the longitudinal direction.

A first partial quantity of the contact lamellae exhibit a first specified width progression along their longitudinal axis (A) and a second partial quantity of the contact lamellae exhibit a second specified width progression along the longitudinal axis (A) which differs from the first width progression and substantially represents an inversion of the first width progression. Additionally, the contact lamellae of the first partial quantity and the contact lamellae of the second partial quantity may alternate.

The torsion webs of at least two adjacent contact lamellae are tilted, in relation to their lamella planes, in the same direction around their respective longitudinal axes (A).

The second width (B2) may be less than half as wide as the first width (B1).

The two connecting bars of two adjacent contact lamellae are arranged offset in relation to one another, at two opposite lamella ends, in such a way that no sectional plane intersects both connecting bars.

The torsion web extends with a substantially constant first width (B1) over more than 75% of the overall length of the contact lamella.

The contact zones of the contact lamellae in each case have a first lateral edge for establishing electrical contact with the first contact element under elastic preload and/or a second lateral edge on the opposite side of the longitudinal axis (A) of the respective contact lamella for establishing electrical contact with the second contact element under elastic preload.

A geometrical connecting line between the first lateral edge and the second lateral edge runs substantially perpendicular to the longitudinal direction (L).

The contact lamellae in each case extend between a first connecting body such as a first support strip or support ring and a second connecting body, spaced apart therefrom in the longitudinal direction (L), such as a second support strip or support ring.

Furthermore, in order to form a lamellar cage or lamellar cages, the contact lamellae are provided in an arrangement extending, at least in sections, in a peripheral direction (U), in a partially annular or annular arrangement.

In a second aspect, the present invention is directed to a plug connector with a contact socket for coupling with a contact pin in a plugging direction (S) running parallel to the longitudinal direction (L) of a contact lamella part, for the transmission of an electrical current or signals between a first contact element and a second contact element which can be coupled therewith, with a plurality of contact lamellae extending substantially parallel to one another in a longitudinal direction (L), in each case with a contact zone for establishing electrical contact with the first contact element and/or the second contact element, wherein the contact zone of a first contact lamella is arranged offset in the longitudinal direction (L) in relation to the contact zone of a second contact lamella, wherein the contact lamellae each have torsion web which, starting out from a first lamella end, is increasingly tilted out of a lamella plane, at least in the contact zone, wherein the lamella plane is a tangent plane to an untilted surface of the torsion web, wherein the torsion web has a first width (B1), at least in the region the contact zone, such that the torsion web transitions, in the direction of the other lamella end, into a connecting bar with a second width (B2) which is less than the first width (B1), wherein the contact lamella part is held in the contact socket.

The plug connector having contact zones of the contact lamellae that are twisted and/or tilted around the respective lamella axis (A) such that their first lateral edges establish electrical contact with an inner wall of the contact socket surrounding the contact lamella part and their second lateral edges project into an inner volume surrounded by the contact lamella part designed to receive the contact pin.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-6 of the drawings in which like numerals refer to like features of the invention.

Figure 6:
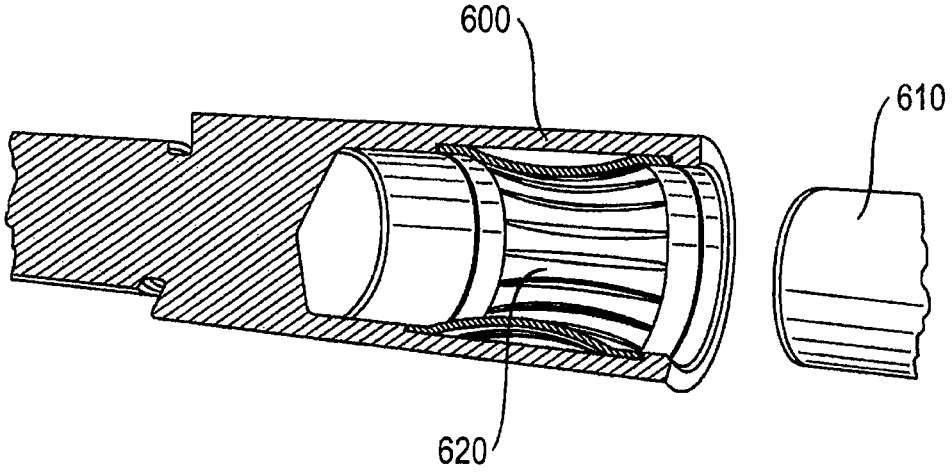
FIG. 6 shows a plug connector with a conventional contact lamella part.

As shown in FIG. 6, contact lamella parts can be held, in the manner of a lamellar cage 620, in the interior of a contact socket 600 such that the contact lamellae of the contact lamella part project, at least in sections, into a receiving space in order to receive a contact pin 610. For this purpose, for example centrally-arranged contact sections of the contact lamellae have a bend projecting radially inwards. If the contact pin 610, which is complementary in design to the contact socket 600, is introduced into the receiving space, the contact lamellae are elastically deformed, radially outwards, and then in a coupled state lie closely against the contact pin 610 under a mechanical preload.

However, it has been found that comparatively high plugging forces are necessary for the coupling of plugged connections which are equipped with such contact lamella parts, since the contact lamellae thereby need to be elastically deformed. Furthermore, in particular for the transmission of high electrical currents or for the transmission of high frequency signals, a particularly low contact resistance is necessary which cannot be reliably and lastingly provided by means of conventional contact lamella parts.

A contact lamella part according to the invention is distinguished in that the contact zone of a first contact lamella is arranged offset in the longitudinal direction in relation to the contact zone of a second contact lamella.

The contact zone of a contact lamella can be understood to mean that section along the longitudinal axis of the contact lamella in which, in a coupled state, the contact lamella lies, under elastic preload, against at least one contact element such as a contact pin or against two contact elements such as a contact pin and a contact socket. The contact lamella can thereby be elastically deformable in the contact zone, transversely to its longitudinal direction, so that on coupling the first contact element and the second contact element, between which the contact lamella acts, it is pressed, under mechanical preload, into close contact with at least one of the contact elements, in particular being pressed against both contact elements.

For example, the contact lamella has in its contact zone a bend, curvature, torsion, or is tilted, twisted, inclined at an angle or similar, so that in the contact zone it projects, at least in sections, from a lamella plane, whereby this projecting section is provided in order to establish contact with at least one contact element under mechanical preload. In this context, a lamella plane is understood to mean a plane which extends through the longitudinal axis of the contact lamella and a transverse axis in the direction of the lamella width.

With an arrangement in which the contact zones of two contact lamellae are offset in the longitudinal direction there is at least one sectional plane perpendicular to the longitudinal axis which only intersects the contact zone of one of the two contact lamellae. In other words, the contact zone of the first contact lamella does not extend, in the longitudinal direction of the lamella, over the same longitudinal section as the contact zone of the second contact lamella. In particular, the contact zone of the first contact lamella is arranged offset from the contact zone of the second contact lamella in such a way that there is no sectional plane perpendicular to the longitudinal axis which intersects both contact zones. In other words, the contact zone of the first contact lamella has already ended, in the longitudinal direction, when the contact zone of the second contact lamella begins. Alternatively, the contact zones of the two contact lamellae only run next to one another in the longitudinal direction over a specified partial section.

The distance between the contact zone of the first contact lamella (or that point of the contact zone which projects furthest from the lamella plane) and the contact zone of the second contact lamella (or that point of the contact zone which projects furthest from the lamella plane) in the longitudinal direction can be more than 10%, preferably more than 20%, in particular 40% or more of the overall length of the contact lamellae.

The invention is based on the knowledge that in conventional contact lamella parts the contact zones of all contact lamellae lie in the same sectional plane, in particular in each case in the middle of the respective contact lamella. During the coupling procedure, the contact zones of all contact lamellae must therefore be elastically deformed at the same time in order for these to be brought to lie closely against the contact element. For this reason, a particularly high plugging force must be applied at a particular point in time, which makes the installation procedure more difficult. In contrast, in the contact lamella part according to the invention the contact zones of individual contact lamellae are arranged offset in relation to one another in the longitudinal direction, so that during the coupling procedure the first contact lamella is elastically deformed first, and only then is the second contact lamella elastically deformed. As a result, the maximum plugging force which needs to be applied is reduced and in particular halved, and at the same time a good contact resistance can be provided.

Furthermore, since, in the contact lamella part according to the invention, the contact zones of two contact lamellae lie in two sectional planes spaced apart from one another in the longitudinal direction of the lamellae, not only a good electrical contact but also a reliable mechanical connection between the contact lamella part and the contact elements can be provided, since at least two spaced-apart contact points are provided along the longitudinal axis of the contact lamellae at which the contact lamella lies against the contact element. This can stabilize a coupled state between the two contact elements.

In order to achieve a reliable electrical contact between the contact zones of the contact lamellae and the contact elements which are to be brought into contact therewith, it has proved expedient if the contact lamellae are, at least in the region of their contact zones, in each case twisted and/or inclined at an angle around their own longitudinal axis.

A twist around its own axis is understood to mean a twisting, a rotation and/or a tilting of the contact lamella over the course of its longitudinal extension. A twist can for example be provided in that a first cross-sectional surface of the contact lamella in a first sectional plane running perpendicular to the longitudinal axis substantially corresponds to a second cross-sectional surface of the contact lamella in a second sectional plane which is spaced apart therefrom, but is twisted or tilted by a specified angle in relation to the first cross-sectional surface.

For example, the contact lamella has, at least in sections, the form of a web with a specified web width in a width direction, wherein the web is, over the course of the longitudinal axis of the contact lamella, increasingly tilted in relation to the original width direction. In some embodiments, the width direction of the web in an untilted web section and the longitudinal axis of the web define the lamella plane, wherein the web is increasingly tilted along its longitudinal extension in relation to the lamella plane, for example up to a tilting angle of more than 5° and less than 90°, in particular more than 15° and less than 45°. The contact lamella preferably exhibits the maximum tilting angle in relation to the lamella plane in the contact zone which is provided in order to establish electrical contact with the first contact element and/or the second contact element.

Preferably, in each sectional plane the longitudinal axis of the contact lamella substantially runs through the middle of the lamella. In other words, the contact lamella does not as a whole follow a curved or bent path in its longitudinal direction, but follows a straight path which is, however, twisted around its own axis. Alternatively, according to the invention a path of the contact lamella which twists around its own axis and at the same time is curved in relation to the longitudinal axis is conceivable. In the case of a curved contact lamella, the longitudinal direction L of the contact lamella also has a curved path which follows the curved longitudinal extension of the contact lamella.

Contact lamellae with a bent or curved path in relation to the longitudinal axis have contact points which are spaced far apart from one another for establishing electrical contact with the two contact elements. Thus, in the coupled state the contact lamella part shown in FIG. 6 makes contact with the contact pin in the middle of the contact lamellae and makes contact with the contact socket at the two ends of the contact lamella part in the longitudinal direction. The current conducting path thereby runs from the middle of the contact lamellae in the longitudinal direction of the contact lamellae as far as the two ends of the contact lamella part. This can lead to a comparatively high contact resistance through the contact lamella part and possibly associated heating and losses.

In contrast, contact lamellae which are twisted or tilted around their own longitudinal axis are suitable both for establishing electrical contact with the first contact element and also for establishing electrical contact with the second contact element within a confined space, namely in the region of the contact zone. This is because a first lateral edge of the tilted contact zone is arranged on the opposite side of the lamella plane from the second lateral edge of the contact zone, so that the current conducting path can substantially run through the contact lamellae in a transverse direction.

In a particularly preferred embodiment, the contact lamella is inclined at an angle in the contact zone such that the current conducting path runs in a width direction from the first lateral edge of the contact zone to the second lateral edge of the contact zone, wherein the first lateral edge of the first contact element and the second lateral edge make electrical contact with the second contact element in substantially the same sectional plane.

Preferably, the first contact lamella is the contact lamella adjacent to the second contact lamella. In other words, the first contact lamella makes electrical contact with at least one of the contact elements in a different sectional plane than the immediately adjacent second contact lamella, which can run parallel next to the first contact lamella. A local heating of the contact lamella part and/or the contact elements can be reduced through this "equalization" of the current flow paths provided through immediately adjacent contact lamellae, which makes the contact lamella part suitable for the transmission of high currents.

According to a particularly preferred embodiment, the contact zones of the contact lamellae are arranged alternatingly in two contact planes spaced apart from one another and running perpendicular to the longitudinal direction. In other words, the contact zones of two adjacent contact lamellae are in each case arranged in different sectional planes. The contact planes in each case thereby intersect that point of the respective contact zone at which the contact zone projects furthest from the lamella plane. The distance between the two contact planes in the longitudinal direction can be more than 5 mm and less than 5 cm, in particular more than 1 cm and less than 3 cm, which can correspond to more than 40% of the overall length of the contact lamellae. The alternating arrangement of the contact zones of adjacent contact lamellae improves coupling stability on the one hand and on the other hand minimizes the plugging force necessary for coupling, since this is applied at two spaced-apart plugging positions, in each case with a force reduced by around half.

In some embodiments, the contact zones of the contact lamellae are not simply arranged alternatingly (XYXYXY etc.) in different contact planes, but in a different sequence. For example, the contact zones are provided in a multiply alternating sequence (for example XXYYXXYY etc.) or a non-alternating sequence (for example XYYXXX etc.). The term "alternatingly" used in the present application also includes a multiply alternating sequence.

A contact lamella part according to the invention can also be used to continue a shielding between a first contact element and a second contact element. In this context it has proved advantageous if a first partial quantity of the contact lamellae exhibit a first specified width progression along their longitudinal axis and a second partial quantity of the contact lamellae exhibit a second specified width progression along the longitudinal axis which differs from the first width progression. In certain designs, the width progression of the first partial quantity of the contact lamellae substantially represents an inversion of the first width progression of the first partial quantity of the contact lamellae.

The contact lamellae of the first partial quantity and the contact lamellae of the second partial quantity can be provided alternatingly. In other words, two adjacent contact lamellae in each case have width progressions along the longitudinal direction which differ from one another and are in particular inverted. For example, starting out from one end of the contact lamella part, the contact lamellae of the first partial quantity narrow by a specified extent whereas, starting out from the same end of the contact lamella part, the contact lamellae of the second partial quantity widen by said specified extent.

This is because it has been found that such an alternating width progression of adjacent contact lamellae can lead to an improved shielding effect, in particular if the contact lamella part is designed in the form of a preferably closed lamellar cage which can surround the at least one signal-carrying conductor. If two adjacent contact lamellae change their width progression next to one another in the same degree, this leads to a particularly sudden change in a shielding provided through the contact lamellae or to a change in characteristic impedance over a short distance. An alternatingly changing width progression of adjacent contact lamellae "equalizes" such sudden changes in the shielding and leads overall to a more constant characteristic impedance over the longitudinal extension of the contact lamella part.

Preferably, the contact lamellae each have a torsion web which, starting out from a first lamella end, is increasingly tilted out of a lamella plane as it extends as far as the contact zone, wherein the lamella plane is a tangent plane to an untilted surface of the torsion web. Such so-called contact lamellae embodying the "torsion spring principle" make possible a particularly low contact resistance and defined contact points on the two contact elements with a short current path over the individual lamellae.

In order to facilitate installation, the torsion webs of at least two adjacent contact lamellae, in particular all contact lamellae, are preferably tilted, in relation to their lamella planes, in the same direction around their respective longitudinal axes.

In order to achieve an overall good shielding effect through the contact lamella part it has proved advantageous if the torsion web has a first width, at least in the region of the contact zone, and transitions, in the direction of the other lamella end, into a connecting bar with a second width which is less than the first width, in particular less than half as wide. A comparatively wide torsion web with small web thickness offers a modulus of torsion which is particularly suitable for a torsion around its own axis. A narrowing of the web width down to a thin connecting bar following the contact zone which is to be twisted during the coupling procedure improves the twistability of the contact zone and thus facilitates the coupling procedure.

Preferably, the two connecting rods of two adjacent contact lamellae are arranged offset in relation to one another in the longitudinal direction such that no sectional plane running perpendicular to the longitudinal direction intersects both connecting rods. This prevents a gap being formed, at least in certain regions, between two adjacent contact lamellae which can have a negative effect in terms of providing a good shielding effect.

In order to achieve a good shielding effect it has proved expedient if the torsion web extends with a preferably substantially constant width over more than half, in particular over more than 75% of the overall length of the contact lamella. A long torsion web facilitates the twistability or tiltability of the contact lamellae during the coupling procedure. A constant width and in particular a constant cross-sectional surface of the torsion webs make possible a uniform distribution of stress along the contact lamellae as far as the contact zone, which can in each case form an end of the torsion web at which the torsion web can transition into the narrower connecting bar.

This means that the contact lamellae can be divided into two regions with different cross sections, namely the torsion web and the connecting bar, wherein the torsion web holds one region elastically and the connecting bar allows a shortened construction design.

In order to achieve a low contact resistance between the contact lamella part and the contact elements while providing a short current path via the contact lamella part it has proved expedient if the contact zones of the contact lamellae in each case have a first lateral edge for establishing electrical contact with the first contact element under elastic preload and/or a second lateral edge on the opposite side of the longitudinal axis of the respective contact lamella for establishing electrical contact with the second contact element under elastic preload.

A particularly short current path can be provided in that a geometrical connecting line between the first lateral edge of the contact zone (or the point of the contact zone most distant from the lamella plane on one side of the lamella plane) and the second lateral edge (or the point of the contact zone most distant from the lamella plane on the other side of the lamella plane) runs substantially perpendicular to the longitudinal direction.

In order to provide a compact component which can be introduced in a simple manner between two contact elements, it has proved advantageous if the contact lamellae in each case extend between a first connecting body such as a first support strip or support ring and a second connecting body, spaced apart therefrom in the longitudinal direction, such as a second support strip or support ring. The support ring is not necessarily round, but can also have an angular geometry, for example a quadrangular geometry, in particular a rectangular or square geometry or an oval geometry. Preferably, the support ring is round, in particular circular.

The contact lamellae can connect the two connecting bodies with one another. For example, the individual contact lamellae in each case run between the two connecting bodies spaced apart at the same distances from the two adjacent contact lamellae. The connecting bodies can be provided in the form of transverse webs running transversely, in particular perpendicular to the longitudinal direction of the contact lamellae, in particular in the form of support rings or support strips.

In some embodiments, the contact lamellae and the connecting bodies in each case enclose an angle of 90° between them. Such embodiments can be designed in the form of straight lamellar cages. In other embodiments, the contact lamellae in each case run at an angle to the connecting bodies. For example, the angle between the longitudinal axis of the respective contact lamella and the direction of extension of the connecting bodies, designed in the form of support strips, amounts in each case to more than 45° and less than 90°, in particular more than 75° and less than 90°.

Such embodiments can be designed in the form of slanting lamellar cages. In the case of slanting lamellar cages, the longitudinal direction of the contact lamellae in each case does not run perpendicular to the direction of extension of the support strip, and due to the curvature of the longitudinal axes L of the contact lamellae resulting from their slanting inclination, the individual contact lamellae do not run exactly parallel to one another, but substantially parallel to one another.

Lamellar cages do not necessarily have a circular geometry in cross section, but can also be oval or angular. For example, a rectangular geometry of the lamellar cage can be provided in order to allow a contact blade to establish electrical contact within a rectangular socket or similar.

One end of each contact lamella can be connected with the first connecting body, and the opposite second end of each contact lamella can be connected with the second connecting body, so that the entirety of the contact lamellae can be held together by the two connecting bodies. The contact lamella part can be manufactured as a single-part or single-piece component, for example of metal. For example, the contact lamella part can be designed in the form of a stamped metal part. A support ring can be a completely circumferential ring element or a partially circumferential ring element which for example extends over an angle of more than 180°, in particular more than 270°.

In order to provide a compact component, it has also proved expedient if, in order to form a lamellar cage, the contact lamellae are provided in an arrangement extending, at least in sections, in a peripheral direction, in particular in a substantially (partially) annular arrangement. A contact lamella part designed as a (partially) annular lamellar cage can for example be received in a cylindrical plug socket (first contact element), into which a cylindrical contact pin (second contact element) can be plugged. Furthermore, a contact lamella part designed as a (partially) annular lamellar cage can be arranged on a cylindrical contact pin for the purpose of coupling with a plug socket. The longitudinal direction of the contact lamellae thereby corresponds to the coupling direction in which the contact pin can be introduced into the contact socket.

A contact lamella part extending at least partially or completely circumferentially in a peripheral direction can be manufactured in that the two ends of an initially flat arrangement of two support strips with contact lamellae running between them are brought together with one another or connected one another, so that a circumferential arrangement of contact lamellae results.

According to a further aspect of the present invention, a plug connector is provided.

According to a first possible embodiment, the plug connector has a contact socket for coupling with a contact pin, wherein a contact lamella part according to one of the preceding claims is held in the contact socket.

According to a second possible embodiment, the plug connector has a contact pin for coupling with a contact socket, wherein a contact lamella part according to one of the preceding claims is held on the contact pin.

The contact pin or the contact socket can have a substantially cylindrical form, and the contact lamella part can be designed in the form of a partially annular or annular lamellar cage. Alternatively, the contact pin can be designed in the form of a contact blade and the contact socket can be designed in the form of a rectangular socket. In this case the contact lamella part can have an angular shape in cross section.

The contact pin can be coupled with the contact socket such that it is introduced into the contact socket in a plugging direction running parallel to the longitudinal axes of the contact lamellae until the contact zones of the contact lamellae of the contact lamella part make electrical contact, under mechanical preload, with both the inner wall of the contact socket and also the outer wall of the contact pin.

Preferably, the contact zones of the contact lamellae are in each twisted or tilted around their respective lamella axis such that their first lateral edges, directed radially outwards, serve to establish electrical contact with an inner wall of the contact socket and their second lateral edges, directed radially inwards, project into an inner volume surrounded by the contact lamella part designed to receive the contact pin.

Figure 1:
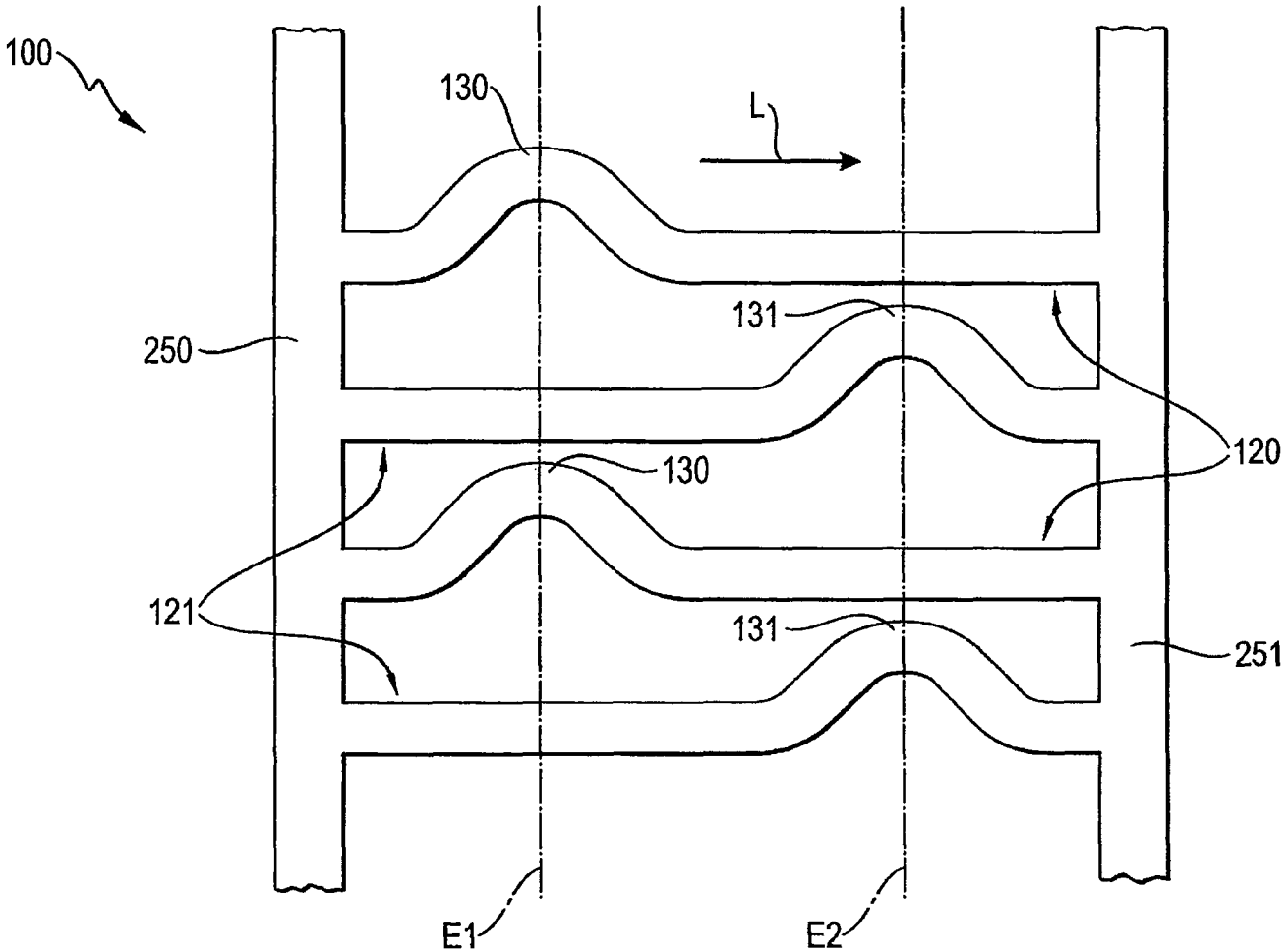
FIG. 1 shows a first embodiment of a contact lamella part according to the invention in a schematic view.

In the following description, the invention is explained with reference to the enclosed drawings:

FIG. 1 shows a first embodiment of a contact lamella part 100 according to the invention in a schematic view. The contact lamella part 100 consists of two connecting bodies 250, 251, running in a transverse direction in the form of support strips, between which a plurality of contact lamellae 120, 121 running parallel to one another in each case extend in a longitudinal direction L. The connecting bodies 250, 251 thereby in each case extend in the lamella plane and are designed in the form of support strips.

Starting out from the first connecting body 250, the contact lamellae 120, 121 in each case extend as far as the second connecting body 251 and are formed in a single piece with the two connecting bodies, for example as a stamped part made of metal or similar. Adjacent contact lamellae 120, 121 are in each case spaced apart in the transverse direction at the same distance from one another.

The contact lamella part 100 is intended for the transmission of an electrical current or signals between a first contact element and a second contact element (not shown). For this purpose, each contact lamella has a contact zone 130, 131 projecting from the lamella plane which is provided in order to establish electrical contact with at least one contact element under preload. In the embodiment shown in FIG. 1, the contact zones 130, 131 are in each case formed as bulges or bends in the contact lamellae which are so resilient that they are elastically deformable in the direction of the lamella plane if the contact lamella part is received between two (flat) contact elements.

The contact zone 130 of a first contact lamella 120 is thereby arranged offset in the longitudinal direction L in relation to the contact zone 131 of a second contact lamella 121, which is the contact lamella adjacent to the first contact lamella 120. The first contact zone 130 or the point on the first contact zone most distant from the lamella plane is intersected by a first contact plane E1 running perpendicular to the longitudinal axis, and the second contact zone 131 or the point on the second contact zone most distant from the lamella plane is intersected by a second contact plane E2 running perpendicular to the longitudinal direction L which is spaced apart from the first contact plane E1 by a specified distance A1 along the longitudinal direction L. The distance A1 can be more than 10% of the overall length of the contact lamellae, in particular more than 40% of the overall length of the contact lamellae.

The contact zones 130, 131 of two adjacent contact lamellae 120, 121 are in each case arranged in different contact planes E1, E2, so that an alternating arrangement of contact zones is formed along the transverse direction.

In the embodiment shown, the two connecting bodies 250, 251 designed in the form of support strips extend perpendicular to the longitudinal axes L of the contact lamellae. A straight lamellar cage is formed by rolling up the support strips illustrated in FIG. 1, with the contact lamellae running between them, to form a ring.

In other embodiments according to the invention (not illustrated), the longitudinal axes L of the contact lamellae in each case extend at an angle (for example an angle between 45° and 90°) to the support strips running parallel to one another. In this case a slanting lamellar cage is formed by rolling up the two support strips to form a ring.

Figure 2:
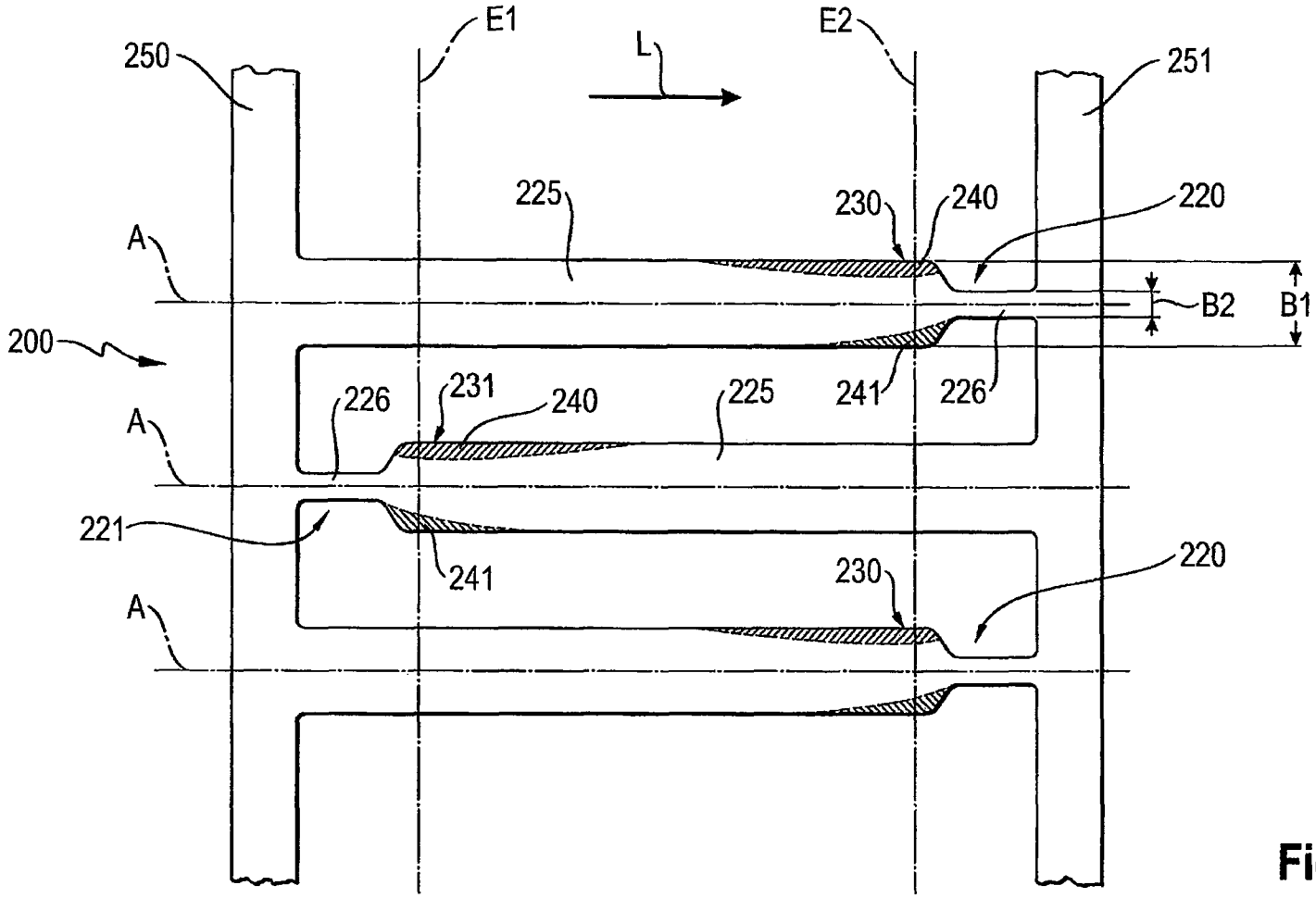
FIG. 2 shows a second embodiment of a contact lamella part according to the invention in a schematic view.

A particularly preferred embodiment of the invention is illustrated in FIG. 2, which shows a schematic representation of a contact lamella part 200 according to the invention.

The contact lamella part 200 also has a plurality of contact lamellae 220, 221 running approximately parallel next to one another which in each case extend between a first connecting body 250 in the form of a support strip and a second connecting body 251 in the form of a support strip.

The contact lamellae 220, 221 in each case extend in a web-like manner in a longitudinal direction L, while the connecting bodies 250, 251 formed in a single part therewith extend roughly perpendicular thereto in the transverse direction. The transverse direction and the longitudinal direction span a lamella plane which corresponds here to the paper plane. A straight lamellar, cage is formed by rolling up the support strips illustrated in FIG. 2, with the contact lamella running between them, to form a ring.

In other embodiments of the invention (not illustrated), the longitudinal axes L of the contact lamellae in each case extend at an angle (for example an angle between 45° and 90°) to the support strips running parallel to one another. In this case a slanting lamellar cage is formed by rolling up the two support strips to form a ring.

Each contact lamella 220, 221 has a contact zone 230, 231 for establishing electrical contact with in each case two contact elements.

The contact lamella part 200 is intended to be arranged between the two contact elements for the transmission of an electrical current between the contact elements. One contact element thereby makes electrical contact with the contact zones of the contact lamellae from one side of the lamella plane, and the other contact element thereby makes electrical contact with the contact zones of the contact lamellae from the other side of the lamella plane.

The contact lamellae 220, 221 are for this purpose designed in the manner of torsion springs which are in each case tilted or inclined at an angle around their own longitudinal axis A, at least in the region of their contact zones 230, 231. A first lateral edge of the contact zone thus lies on one side of the lamella plane (above the paper plane) and serves to establish electrical contact with the first contact element under elastic preload, and a second opposite lateral edge of the contact zone lies on the other side of the lamella plane (beneath the paper plane) and serves to establish electrical contact with the second contact element under elastic preload. This provides a particularly short current path which leads, substantially perpendicular to the longitudinal direction L, via the contact lamellae.

The contact zones 230, 231 of two adjacent contact lamellae are in each case arranged offset in relation to one another in the longitudinal direction. This results, overall, in an alternating arrangement of contact zones in the direction of extension of the connecting bodies 250, 251.

In other words, the contact zone 231 of a first contact lamella 221 (or the point on the contact zone most distant from the lamella plane) is intersected by a first contact plane E1, and the contact zone 230 of a second contact lamella 220 (or the point on the contact zone most distant from the lamella plane) is intersected by a second contact plane E2, which is spaced at a distance from the first contact plane E1, wherein the distance A1 can be greater than 25% of the overall length of the contact lamellae, in particular greater than 50% of the overall length of the contact lamellae.

The contact lamellae 220, 221 in each case have, on the one hand, a torsion web 225, including the contact zones, with a first width B1 in the transverse direction, and on the other hand a thinner connecting bar 226 with a second width B2 in the transverse direction. The torsion web 225 extends, in each case starting out from one of the connecting bodies 250, 251, in the direction of the other connecting body 251, 250 as far as the contact zone, in which it is tilted. Following the contact zone, the torsion web 225 in each case transitions into the connecting bar 226 which connects the torsion web with the other connecting body, thus stabilizing the torsion web and making possible its elastic deformation transversely to the lamella plane.

Two adjacent contact lamellae thereby in each case exhibit an inverse width progression. For example, the torsion web of the first contact lamella 220 is connected with the first connecting body 250, and the connecting bar of the first contact lamella 220 is connected with the second connecting body 251. Conversely, the connecting bar of the second contact lamella 221 is connected with the first connecting body 250 and the torsion web of the second contact lamella 221 is connected with the second connecting body 251. This results in an alternating width progression of the contact lamellae, which leads to a contact lamella with a particularly good shielding effect, since the thin connecting rods 226, which thus create a wide gap, are in each case arranged offset in relation to one another.

The torsion webs 250 can thereby in each case extend over more than half, in particular over more than 75% of the overall length of the contact lamellae and preferably have a substantially constant web width.

Figure 3A:
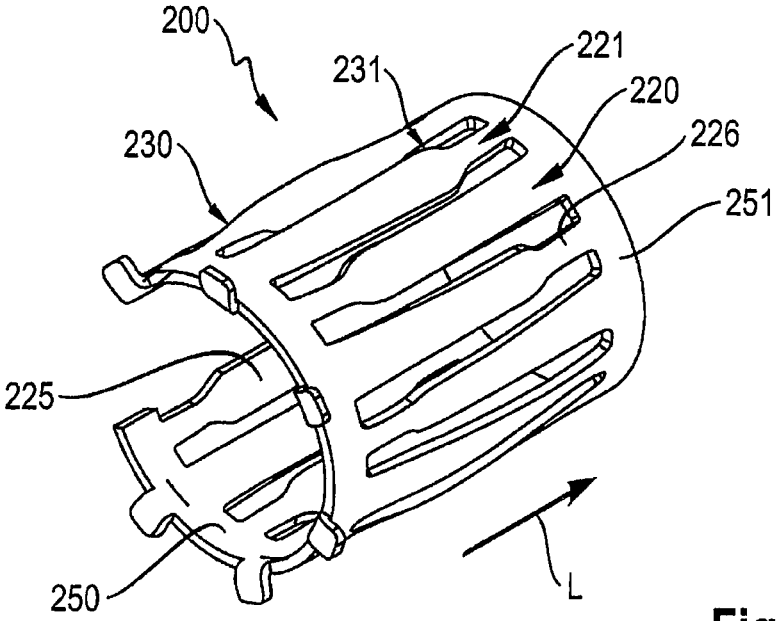
FIG. 3A shows a third embodiment of a contact lamella part according to the invention in a perspective view.
Figure 3B:
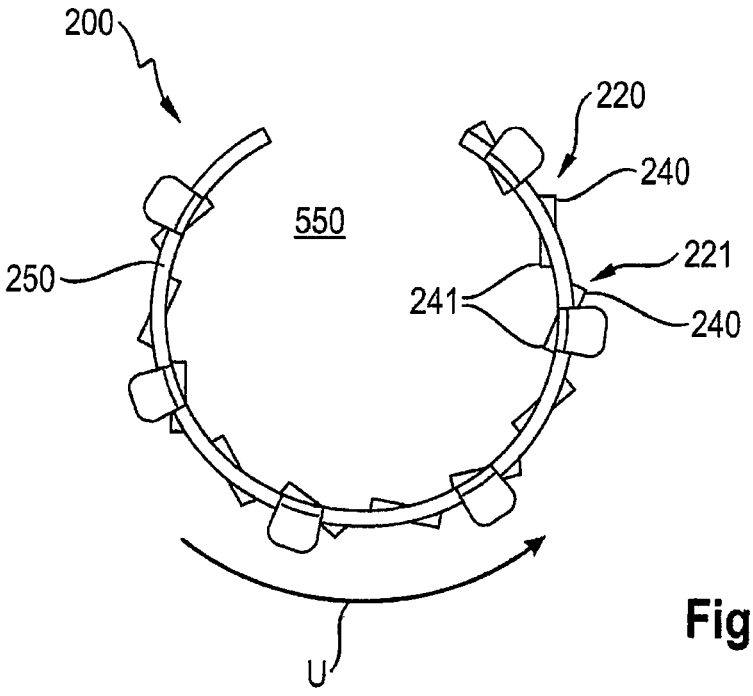
FIG. 3B shows the embodiment shown in FIG. 3A in a frontal view.

A third preferred embodiment of the invention in the form of a straight lamellar cage is illustrated in FIGS. 3A and 3B. FIG. 3A shows a contact lamella part 200 according to the invention in a perspective view, and FIG. 3B shows the contact lamella part 200 in a frontal view.

The contact lamella part 200 is designed in the manner of a lamellar cage which extends at least partially circumferentially in a peripheral direction U. A plurality of contact lamellae 220, 221, in each case extending in a longitudinal direction L, are thereby arranged next to one another in the peripheral direction U. The contact lamellae 220, 221 in each case extend, starting out from a first connecting body 250, in the form of a partial ring or ring segment as far as a second connecting body 251 in the form of a partial ring or ring segment.

The contact lamella part shown in FIG. 3*a* can be manufactured by bending the flat contact lamella part illustrated in FIG. 2 into a ring, so that, in terms of the arrangement and structure of the contact lamellae 220, 221, reference can be made to the above explanations.

In particular, the contact lamellae are in each case, at least in the region of their contact zones 230, 231, twisted or tilted around their own axis. Each contact lamella has a torsion web 225 which, starting out from a contact lamella end, is increasingly tilted in relation to a lamella plane, wherein the region of maximum tilting defines the contact zone of the respective contact lamella. The lamella plane is thereby defined through a tangent plane to an untilted radial outer surface of the torsion web.

As in the case of the embodiment illustrated in FIG. 2, the contact zones of two adjacent contact lamellae are arranged offset in relation to one another in the longitudinal direction L, so that an alternating arrangement of the contact zones in the peripheral direction results. Instead of the illustrated alternating arrangement of the contact zones, a different sequence of the contact zones in the peripheral direction can be provided.

The contact lamella part 200 is intended for the transmission of an electrical current between a first contact element such as a contact socket and a second contact element such as a contact pin. The first lateral edges 240 of the contact zones 230, 231 which project radially outwards are intended to establish electrical contact with an inner wall of the contact socket under mechanical preload, and the second lateral edges 241 of the contact zones 230, 231 which project inwards into an inner volume of the lamellar cage are intended to establish electrical contact with an outer wall of the contact pin under mechanical preload. This can be seen particularly clearly in FIG. 3B. Furthermore, it can be seen in FIG. 3B that the torsion webs of the contact lamellae are in each case tilted in the same direction around their respective longitudinal axes A in relation to their respective lamella planes.

Figure 4:
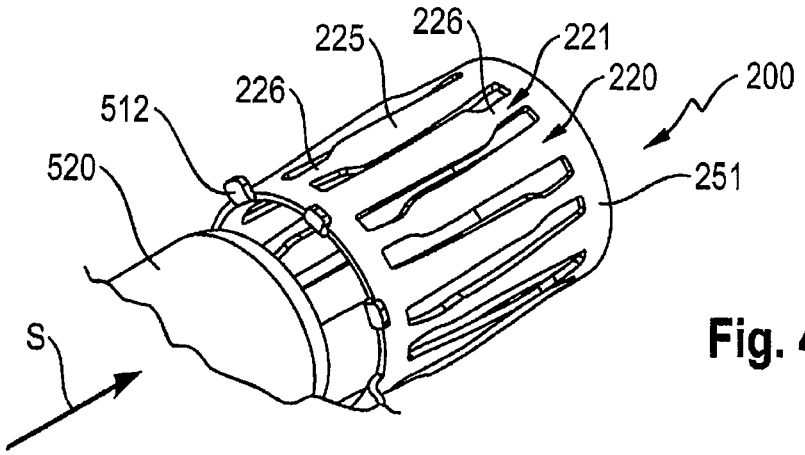
FIG. 4 shows the embodiment of a contact lamella part according to the invention shown in FIG. 3A together with a contact element in the form of a contact pin.

FIG. 4 shows the embodiment of a contact lamella part 200 according to the invention illustrated in FIG. 3A together with a contact element in the form of a contact pin 520. For the purpose of coupling, the contact pin 520 is introduced in a plugging direction S into an inner volume of the partially annular contact lamella part 200.

During the course of the coupling procedure, the contact zones 230 of the first contact lamellae 220 which are tilted in relation to the peripheral direction U are first elastically deformed, in that they are forced radially outwards by the outer wall of the contact pin 520 and are thereby partially twisted back. Only then are the contact zones 231 of the second contact lamellae 221, which are also tilted in relation to the peripheral direction U and which are offset in relation to the contact zones 230 of the first contact lamellae 220 by a distance A1 in the longitudinal direction L, which corresponds to the plugging direction S, elastically deformed. This facilitates the coupling procedure.

Figure 5A:
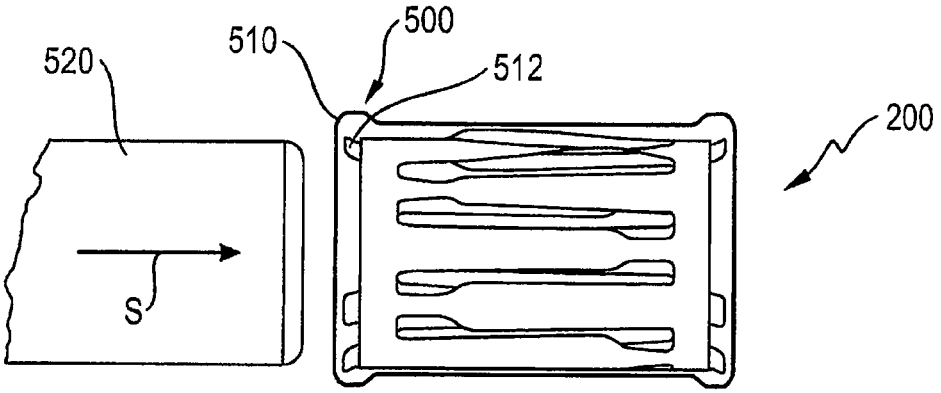
FIG. 5A shows a plug connector according to the invention with a contact lamella part received in a contact socket.
Figure 5B:
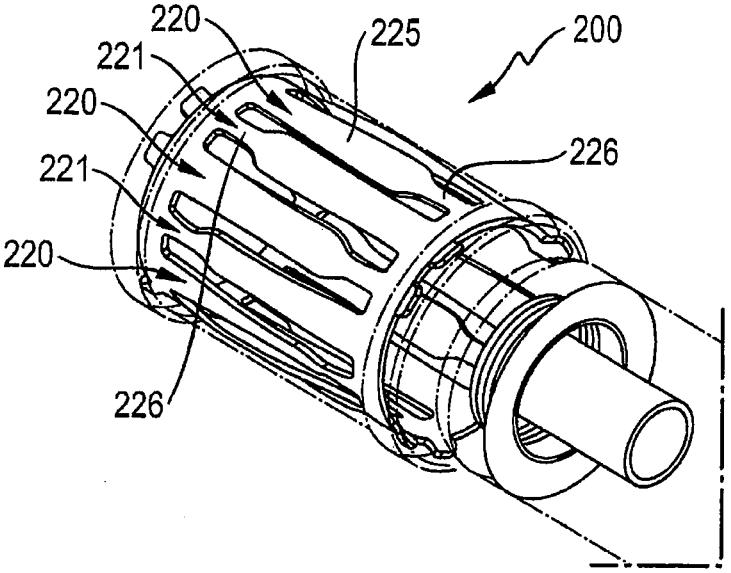
FIG. 5B shows the plug connector shown in FIG. 5A in a perspective view.

FIG. 5A shows a plug connector 500 according to the invention with a contact lamella part 200 received in a contact socket 510. The contact lamella part 200 can have projections such as noses 512 which project radially outwards, by means of which the contact lamella part 200 can be fixed in the contact socket 510. FIG. 5B shows the plug connector 500 shown in FIG. 5A in a perspective view.

The contact socket 510 is substantially hollow cylindrical in form and is designed to allow the insertion of a complementary-formed contact pin 520 in the plugging direction S.

The contact lamella part 200 has a plurality of contact lamellae 220, 221 arranged next to one another in a peripheral direction U and extending in the plugging direction S, the contact zones of which are tilted around their respective lamella axis in such a way that their first lateral edges 240 establish electrical contact with an inner wall of the contact socket 510 surrounding the contact lamella part and their second lateral edges 241 project into an inner volume 550 surrounded by the contact lamella part intended to receive the contact pin 520.

The contact zones of adjacent contact lamellae are in each case arranged offset in the plugging direction in relation to one another. Furthermore, the width progressions of adjacent contact lamellae are in each case substantially inverse in relation to one another. On the one hand, this makes possible a simpler coupling procedure. On the one hand, due to the short current paths, a low contact resistance can be made possible, so that the contact lamella part according to the invention is suitable for the transmission of high currents. Furthermore, a good shielding effect can be provided, so that the contact lamella part according to the invention can be used for the transmission of signals or in order to shield one of more signal conductors.

Instead of the single alternating arrangement of the contact zones of adjacent contact lamellae 220, 221 in two contact planes illustrated in the figures, other sequences can also be provided. If those contact lamellae whose contact zones are located in the first contact plane E1 are designated with X, and those contact lamellae whose contact zones are located in the second contact plane E2 are designated with Y, instead of the single alternating sequence XYXYXY which is illustrated in the figures, a double alternating sequence XXYYXXYY or a multiply alternating sequence XXXXYYYYXXXXYYYY or similar can for example be provided in the direction of extension of the support strips U. Alternatively, a symmetric alternating sequence XYYXYY, XXYXXY, XYYYXYYY, XXXYXXXY or similar can be provided. As a further alternative, the sequence of the contact lamellae X and the contact lamellae Y may not be alternating, for example XYYXXYYY or similar. As a further alternative, a third group of contact lamellae Z are provided, the contact zones of which are offset in the longitudinal direction L both in relation to the contact zones of the first contact lamellae X as well as in relation to the contact zones Y of the second contact lamellae.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A contact lamella part for the transmission of an electrical current or signals between a first contact element and a second contact element which can be coupled therewith, with a plurality of contact lamellae extending substantially parallel to one another in a longitudinal direction (L), in each case with a contact zone for establishing electrical contact with the first contact element and/or the second contact element, wherein the contact zone of a first contact lamella is arranged offset in the longitudinal direction (L) in relation to the contact zone of a second contact lamella, wherein the contact lamellae each have torsion web which, starting out from a first lamella end, is increasingly tilted out of a lamella plane, at least in the contact zone, wherein the lamella plane is a tangent plane to an untilted surface of the torsion web, wherein the torsion web has a first width (B1), at least in the region the contact zone, such that the torsion web transitions, in the direction of the other lamella end, into a connecting bar with a second width (B2) which is less than the first width (B1).

2. The contact lamella part of claim 1, wherein the contact lamellae are, at least in the region of their contact zones, in each case twisted around their own longitudinal axis (A).

3. The contact lamella part according of claim 1, wherein the first contact lamella is adjacent to the second contact lamella.

4. The contact lamella part of claim 1, wherein the contact zones of adjacent contact lamellae are arranged alternatingly in two contact planes (E1, E2) spaced apart from one another and running perpendicular to the longitudinal direction.

5. The contact lamella part of claim 1, wherein a first partial quantity of the contact lamellae exhibit a first specified width progression along their longitudinal axis (A) and a second partial quantity of the contact lamellae exhibit a second specified width progression along the longitudinal axis (A) which differs from the first width progression and substantially represents an inversion of the first width progression.

6. The contact lamella part of claim 5, wherein the contact lamellae of the first partial quantity and the contact lamellae of the second partial quantity alternate.

7. The contact lamella part of claim 1, wherein the torsion webs of at least two adjacent contact lamellae are tilted, in relation to their lamella planes, in the same direction around their respective longitudinal axes (A).

8. The contact lamella part according to claim 7, wherein the second width (B2) is less than half as wide as the first width (B1).

9. The contact lamella part of claim 8, wherein the two connecting bars of two adjacent contact lamellae are arranged offset in relation to one another, at two opposite lamella ends, in such a way that no sectional plane intersects both connecting bars.

10. The contact lamella part of claim 7, wherein the torsion web extends with a substantially constant first width (B1) over more than 75% of the overall length of the contact lamella.

11. The contact lamella part of claim 7, wherein the torsion web extends with a substantially constant first width (B1) over more than half of the overall length of the contact lamella.

12. The contact lamella part of claim 1, wherein the contact zones of the contact lamellae in each case have a first lateral edge for establishing electrical contact with the first contact element under elastic preload and/or a second lateral edge on the opposite side of the longitudinal axis (A) of the respective contact lamella for establishing electrical contact with the second contact element under elastic preload.

13. The contact lamella part of claim 12, wherein a geometrical connecting line between the first lateral edge and the second lateral edge runs substantially perpendicular to the longitudinal direction (L).

14. The contact lamella part of claim 1, wherein the contact lamellae in each case extend between a first connecting body such as a first support strip or support ring and a second connecting body, spaced apart therefrom in the longitudinal direction (L), such as a second support strip or support ring.

15. The contact lamella part of claim 1, wherein, in order to form a lamellar cage or lamellar cages, the contact lamellae are provided in an arrangement extending, at least in sections, in a peripheral direction (U), partially annular or annular arrangement.

16. The contact lamella part of claim 1, wherein the torsion webs of all contact lamellae are tilted, in relation to their lamella planes, in the same direction around their respective longitudinal axes (A).

17. A plug connector with a contact socket for coupling with a contact pin in a plugging direction (S) running parallel to the longitudinal direction (L) of a contact lamella having a contact lamella part, for the transmission of an electrical current or signals between a first contact element and a second contact element which can be coupled therewith, with a plurality of said contact lamellae extending substantially parallel to one another in a longitudinal direction (L), in each case with a contact zone for establishing electrical contact with the first contact element and/or the second contact element, wherein the contact zone of a first contact lamella is arranged offset in the longitudinal direction (L) in relation to the contact zone of a second contact lamella, wherein the contact lamellae each have torsion web which, starting out from a first lamella end, is increasingly tilted out of a lamella plane, at least in the contact zone, wherein the lamella plane is a tangent plane to an untilted surface of the torsion web, wherein the torsion web has a first width (B1), at least in the region the contact zone, such that the torsion web transitions, in the direction of the other lamella end, into a connecting bar with a second width (B2) which is less than the first width (B1), wherein the contact lamella part is held in the contact socket.

18. The plug connector of claim 17, wherein the contact zones of the contact lamellae are twisted and/or tilted around the respective lamella axis (A) such that their first lateral edges establish electrical contact with an inner wall of the contact socket surrounding the contact lamella part and their second lateral edges project into an inner volume surrounded by the contact lamella part designed to receive the contact pin.

* * * * *